US010285488B2

(12) United States Patent
Villarreal et al.

(10) Patent No.: US 10,285,488 B2
(45) Date of Patent: May 14, 2019

(54) COMBINATION DISPENSER AND APPLICATOR

(71) Applicant: HCT GROUP HOLDINGS LIMITED, Central (HK)

(72) Inventors: Armando Villarreal, Los Angeles, CA (US); Kamaal Washington, Los Angeles, CA (US); Stephen Burditt, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 14/796,075

(22) Filed: Jul. 10, 2015

(65) Prior Publication Data

US 2016/0007718 A1 Jan. 14, 2016

Related U.S. Application Data

(60) Provisional application No. 62/023,331, filed on Jul. 11, 2014.

(51) Int. Cl.
*A46B 11/00* (2006.01)
*A45D 40/28* (2006.01)
(Continued)

(52) U.S. Cl.
CPC ..... *A45D 40/28* (2013.01); *A45D 34/042* (2013.01); *A45D 40/0075* (2013.01);
(Continued)

(58) Field of Classification Search
CPC ..... A45D 34/042; A46B 15/00; A46B 11/00
(Continued)

(56) References Cited

U.S. PATENT DOCUMENTS 4,974,981 A * 12/1990 Bennett ..... A45D 33/00 401/123
5,339,483 A * 8/1994 Byun ..... A45D 40/10 132/313

(Continued)

FOREIGN PATENT DOCUMENTS

JP 2013518702 A 5/2013
WO WO 2009120234 A1 * 10/2009 ..... A45D 34/042
WO 2011100664 A1 8/2011

OTHER PUBLICATIONS

PCT Appl. No. 2015/039966, The International Search Report and the Written Opinion of the International Searching Authority dated Oct. 9, 2015.

*Primary Examiner* — David J Walczak
*Assistant Examiner* — Joshua R Wiljanen
(74) *Attorney, Agent, or Firm* — Seager, Tufte & Wickhem LLP

(57) ABSTRACT

A device for dispensing and applying a cosmetic product includes a bottle, a cosmetic dispensing member, and a cosmetic applicator. The bottle contains a volume of cosmetic product and comprises a closed end and an open end. The cosmetic dispensing member is coupled to the open end of the bottle. The cosmetic dispensing member includes an outlet and an actuating element configured to be actuated to enable delivery of a portion of the volume of cosmetic product through the outlet. The cosmetic applicator is coupled to the closed end of the bottle by one or more collar members.

10 Claims, 6 Drawing Sheets

(51) Int. Cl.
*A45D 40/00* (2006.01)
*A45D 40/26* (2006.01)
*A45D 34/04* (2006.01)

(52) U.S. Cl.
CPC ..... *A45D 40/262* (2013.01); *A45D 2200/054* (2013.01); *A46B 11/001* (2013.01)

(58) Field of Classification Search
USPC .... 401/123, 102, 21, 6, 209, 219; 15/104.94
See application file for complete search history.

(56) References Cited

U.S. PATENT DOCUMENTS 5,577,851 A * 11/1996 Koptis ..... A45D 34/04 401/183
6,010,264 A * 1/2000 Scuderi ..... A45D 34/041 401/209
6,224,287 B1 * 5/2001 Gieux ..... A45D 33/34 15/207.2
7,044,341 B2 * 5/2006 Sanchez ..... B05B 11/0027 222/321.6
8,292,535 B2 * 10/2012 Thorpe ..... A45D 34/04 401/265
8,297,869 B2 * 10/2012 Gueret ..... A45D 34/04 401/265
8,671,499 B2 * 3/2014 Lim ..... A46B 5/005 132/120
D717,548 S * 11/2014 Lim ..... D4/135
9,210,994 B2 * 12/2015 Brown ..... A46B 9/02
9,247,803 B2 * 2/2016 Lim ..... A45D 33/006
2002/0014246 A1 * 2/2002 Choi ..... A45D 33/02 132/112
2002/0057939 A1 * 5/2002 Gueret ..... A45D 34/045 401/126
2004/0089318 A1 * 5/2004 Tahara ..... A45D 33/006 132/317
2004/0213628 A1 * 10/2004 Thiebaut ..... A45D 29/007 401/205
2005/0273962 A1 * 12/2005 Dillon ..... A46B 9/10 15/169
2005/0286966 A1 * 12/2005 Gueret ..... A45D 34/04 401/130
2006/0026783 A1 * 2/2006 McKay ..... A01K 13/002 15/104.94
2007/0206986 A1 * 9/2007 Gueret ..... A45D 34/04 401/123
2008/0023025 A1 * 1/2008 Burtzlaff ..... A45D 40/0087 132/320
2008/0283083 A1 * 11/2008 Piao ..... A45C 11/008 132/317
2009/0162131 A1 * 6/2009 Thorpe ..... A45D 34/042 401/172
2010/0054844 A1 * 3/2010 Thorpe ..... A45D 40/06 401/172
2013/0017010 A1 1/2013 Liu
2015/0101630 A1 * 4/2015 Kodama ..... A45D 19/02 132/200
2015/0282594 A1 * 10/2015 Lim ..... A45D 40/28 401/138
2016/0007718 A1 * 1/2016 Villarreal ..... A45D 40/0075 401/117
2016/0015150 A1 * 1/2016 Casasanta, III ..... A45D 40/262 401/4
2016/0051028 A1 * 2/2016 Lahousse ..... A45D 34/042 132/200

* cited by examiner

COMBINATION DISPENSER AND APPLICATOR

RELATED APPLICATION

This application claims priority to U.S. Provisional Application No. 62/023,331, filed Jul. 11, 2014, the entire disclosure of which is herein incorporated by reference.

TECHNICAL FIELD

The present disclosure relates generally to a cosmetic applicator which combines a pump for dispensing cosmetic product and a blending sponge in a single unit.

SUMMARY

According to some embodiments of the present disclosure, a device for dispensing and applying a cosmetic product includes a bottle, a cosmetic dispensing member (e.g., airless pump), and a cosmetic applicator (e.g., blending sponge). The bottle contains a volume of cosmetic product and comprises a closed end and an open end. The cosmetic dispensing member is coupled to the open end of the bottle. The cosmetic dispensing member includes an outlet and an actuating element configured to be actuated to enable delivery of a portion of the volume of cosmetic product through the outlet. The cosmetic applicator is coupled to the closed end of the bottle by one or more collar members. In one embodiment, these one or more collar members include a bottle collar member connected to the closed end of the bottle and a sponge collar member connected to the bottle collar member and the cosmetic applicator. In some embodiments, the device further comprises a cap member fit removably over the cosmetic applicator while the device is in a closed configuration.

An example device for dispensing and applying a cosmetic product is disclosed. The device comprises:

a bottle configured to hold a volume of cosmetic product, the bottle comprising a closed end and an open end;

a cosmetic dispensing member coupled to the open end of the bottle and comprising:

an outlet;

an actuating element configured to be actuated to enable delivery of a a portion of the volume of cosmetic product through the outlet; and a cosmetic applicator coupled to the closed end of the bottle by one or more collar members.

Alternatively or additionally to any of the embodiments above, the one or more collar members comprise:

a bottle collar member connected to the closed end of the bottle; and a sponge collar member connected to the bottle collar member and the cosmetic applicator.

Alternatively or additionally to any of the embodiments above, further comprising:

a cap member fit removably over the cosmetic applicator while the device is in a closed configuration.

Alternatively or additionally to any of the embodiments above, the cosmetic dispensing member is an airless pump.

Alternatively or additionally to any of the embodiments above, the cosmetic applicator is a blending sponge.

Alternatively or additionally to any of the embodiments above, the cosmetic applicator is a brush.

Alternatively or additionally to any of the embodiments above, the brush is coupled to a brush holder.

Alternatively or additionally to any of the embodiments above, further comprising a sleeve slidably coupled to the brush holder.

Alternatively or additionally to any of the embodiments above, the sleeve is designed to shift between a first position where the sleeve covers the brush and a second position where the brush is exposed.

Alternatively or additionally to any of the embodiments above, the sleeve includes a flange that is designed to engage a bump formed along the brush holder.

An example combination dispenser and applicator is disclosed. The combination dispenser and applicator comprises:

a bottle designed to hold a cosmetic product, the bottle comprising a first end and second end;

a cosmetic dispensing member coupled to the first end of the bottle, the cosmetic dispensing member comprising an outlet and an actuating element configured to be actuated for delivery of a portion of the cosmetic product through the outlet; and a cosmetic applicator coupled to the second end of the bottle.

Alternatively or additionally to any of the embodiments above, further comprising a bottle collar member connected to the second end of the bottle and a sponge collar member connected to the bottle collar member and the cosmetic applicator.

Alternatively or additionally to any of the embodiments above, further comprising:

a cap member fit removably over the cosmetic applicator while the combination dispenser and applicator is in a closed configuration.

Alternatively or additionally to any of the embodiments above, the cosmetic dispensing member is an airless pump.

Alternatively or additionally to any of the embodiments above, the cosmetic applicator is a blending sponge.

Alternatively or additionally to any of the embodiments above, the cosmetic applicator is a brush.

Alternatively or additionally to any of the embodiments above, the brush is coupled to a brush holder, and further comprising a sleeve slidably coupled to the brush holder.

Alternatively or additionally to any of the embodiments above, the sleeve is designed to shift between a first position where the sleeve covers the brush and a second position where the brush is exposed.

Alternatively or additionally to any of the embodiments above, the sleeve includes a flange that is designed to engage a bump formed along the brush holder.

Another example combination dispenser and applicator is disclosed. The combination dispenser and applicator comprises:

a bottle designed to hold a cosmetic product, the bottle comprising a first end and second end;

a cosmetic dispensing member coupled to the first end of the bottle, the cosmetic dispensing member comprising an outlet and an actuating element configured to be actuated for delivery of a portion of the cosmetic product through the outlet;

a collar coupled to the second end of the bottle; and a cosmetic applicator coupled to the collar.

Additional features and advantages of the disclosure will be made apparent from the following detailed description of illustrative embodiments that proceeds with reference to the accompanying drawings.

BRIEF DESCRIPTION OF THE DRAWINGS

The foregoing and other aspects of the present disclosure are best understood from the following detailed description when read in connection with the accompanying drawings. For the purpose of illustrating examples of the disclosure, there are shown in the drawings embodiments, it being understood, however, that the disclosure is not limited to the specific instrumentalities disclosed. Included in the drawings are the following Figures.

DETAILED DESCRIPTION

The present disclosure relates generally to a device which combines cosmetic product dispensing and application components in a single unit. This technology is particularly well-suited for, but by no means limited to, cosmetic products such as liquid concealer or foundation.

Figure 1:
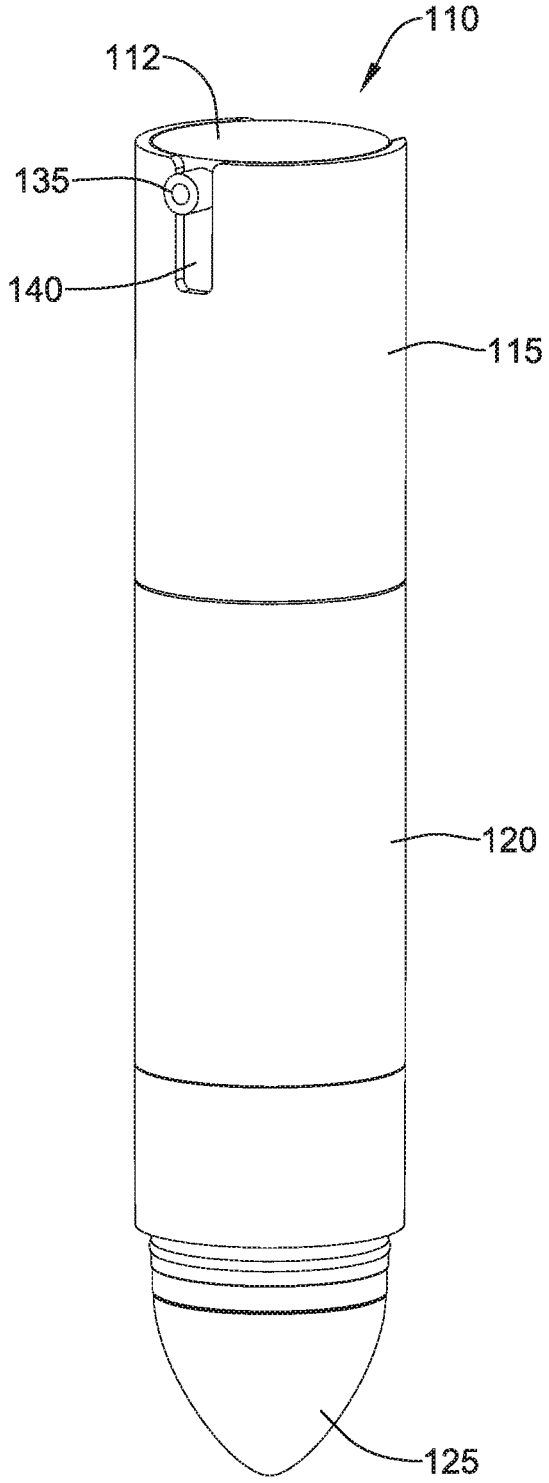
FIGS. 1 and 2 provide an open view and a closed view, respectively, of a combination dispenser and applicator, along with a view of a Blending Sponge used therein, according to some embodiments of the present disclosure.
Figure 2:
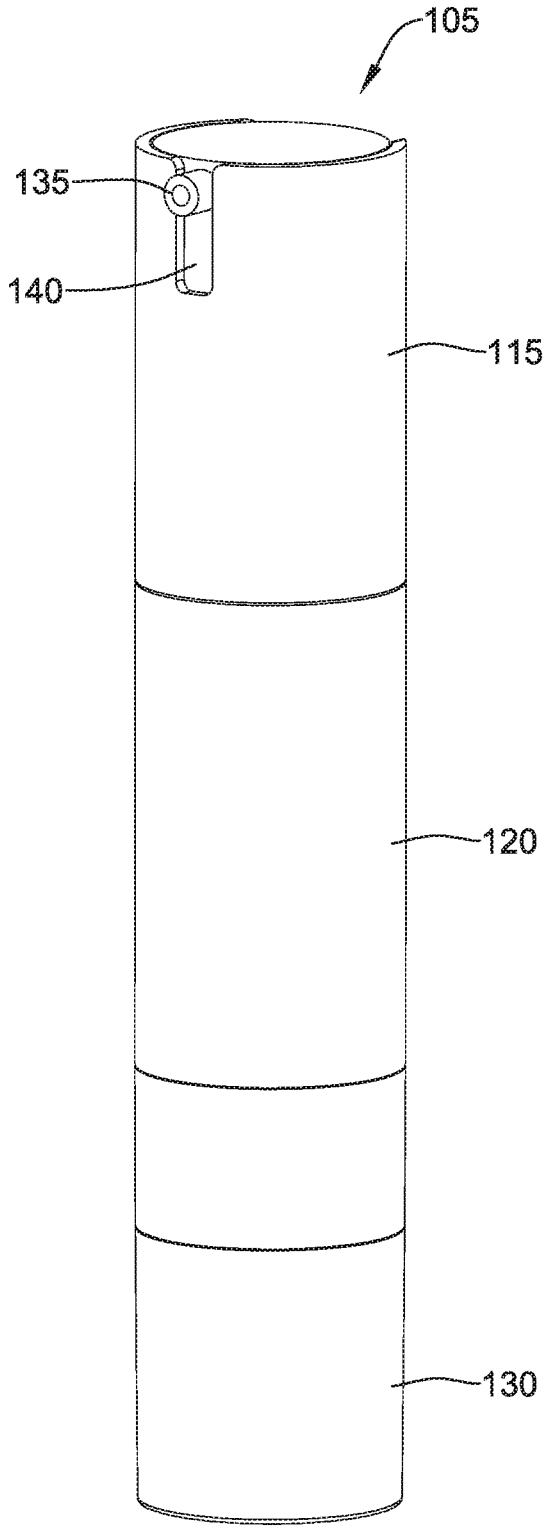

FIG. 1 provides an open view 110 and FIG. 2 provides a closed view 105 of a Combination Dispenser and Applicator, along with a view of a Blending Sponge 125 used therein, according to some embodiments of the present disclosure. As shown in the closed view 105 and the open view 110, the Combination Dispenser and Applicator includes a Pump 115 for dispensing cosmetic product from a Bottle 120. The open view 110 shows a cosmetic applicator, or more particularly, a Blending Sponge 125 located on the end of the Combination Dispenser and Applicator opposite to the Pump 115. In the closed position 105, the Combination Dispenser and Applicator includes a Sponge Cap 130 removably fit over the Blending Sponge 125. In the example of FIGS. 1-2, the Combination Dispenser and Applicator is shown in an elongated cylindrical configuration. However, it should be understood that embodiments of the disclosure described herein may be applied to various other configurations in other embodiments. For example, the Combination Dispenser and Applicator may alternatively be embodied in an elongated cubical configuration where the components of the device are all cubical in shape.

Activation of the Pump 115 removes a portion of the cosmetic product from the Bottle 120 via a vacuum effect and dispenses that portion through an outlet 135 in the Pump 115. The technique used for activating Pump 115 may vary according to different embodiments of the present disclosure. In the example of FIG. 1, the Pump 115 is activated by depressing an actuating element 112 on an inner region (not shown in FIGS. 1-2) of the Pump 115 in a direction towards the Bottle 120. This causes the inner region of the Pump 115 to be lowered, with the outlet 135 on the Bottle 120 moving down along a groove 140 on the face of the Bottle 120. As the Pump 115 is lowered a vacuum effect is created and makeup is dispensed through the outlet 135.

In some embodiments, the Pump 115 is part of an airless pump system. For example, in one embodiment where an airless pump is used, a small piston (not shown in FIGS. 1-2) sits on the bottom of the cosmetic product inside the Bottle 120. When the Pump 115 is activated, the piston pushes the material to the top of the bottle as the vacuum effect pulls the piston upwards. A small hole (not shown in FIGS. 1-2) may be provided in the bottom of the Bottle 120 to allow for air to fill the space beneath the piston as cosmetic product is removed. In other embodiments where an airless pump is used, the Bottle 120 includes an elastically deformable diagram which acts to push material out of the Bottle 120 and through the Pump 115. Various types of materials may be used for constructing the Bottle 210 including, for example, plastic-based materials and glass.

The Blending Sponge 125 is made of a material suitable for controlled application and blending of the cosmetic product material stored in Bottle 120 on the user's skin. In some embodiments, such as that illustrated in FIGS. 1-2, the Blending Sponge 125 includes a pointed end that may be used, for example, to apply cosmetic product to smaller areas, such as around the user's eyes or nose. In other embodiments, the pointed end may be omitted and the Blending Sponge 125 may be an alternate shape. These alternate shapes may include, without limitation, round, square, rectangular, teardrop, or wedge-shaped sponges. The Blending Sponge 125 may be made of various materials including, without limitation, foam, latex, rubbers, and/or natural sponge materials. The Blending Sponge 125 can be removed from the Combination Dispenser and Applicator in some embodiments, thereby allowing a user to clean the Blending Sponge 125 or replace it with an alternative sponge (not shown in FIGS. 1-2).

Figure 3:
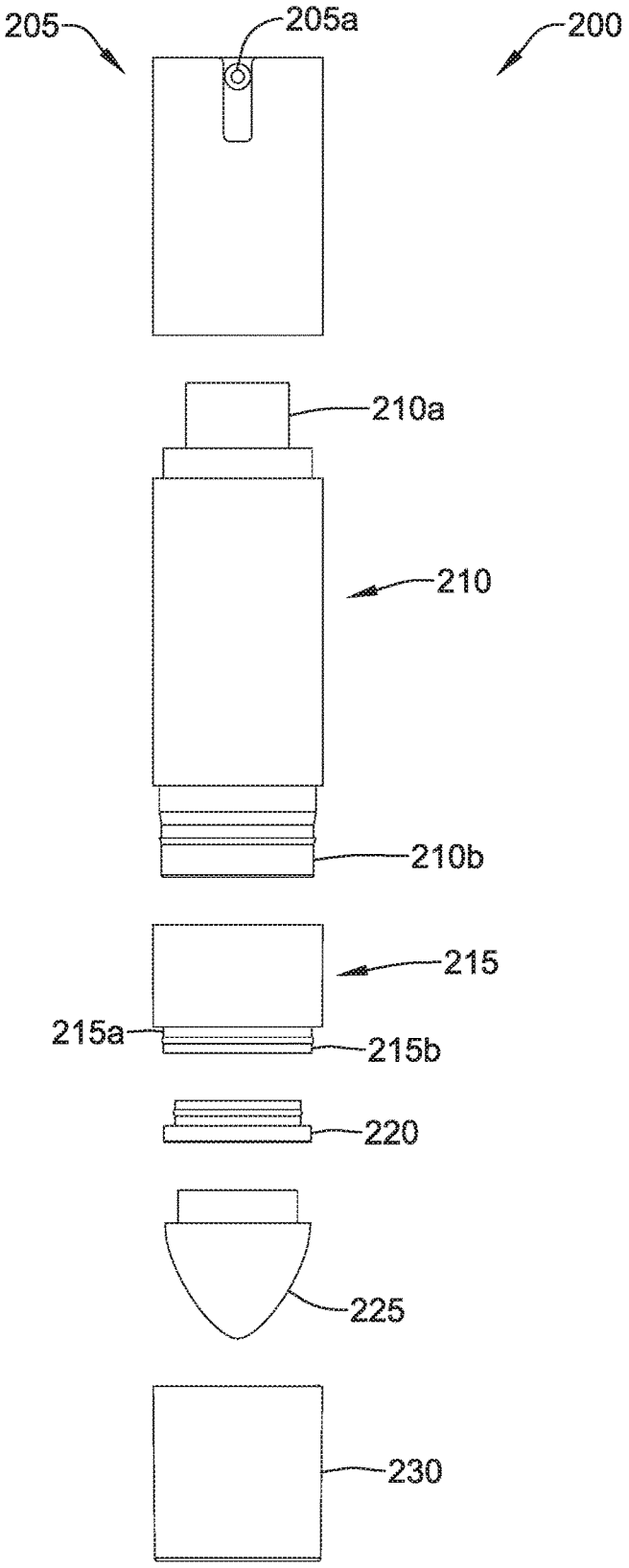
FIG. 3 provides an exploded view of a Combination Dispenser and Applicator in a cylindrical configuration, according to some embodiments of the present disclosure.

FIG. 3 provides an exploded view 200 of a Combination Dispenser and Applicator in a cylindrical configuration, according to some embodiments of the present disclosure. Conceptually, in this example, the Combination Dispenser and Applicator may be viewed as including two ends, referred to herein as the pump end and the blending end. On the pump end, Pump 205 is attached to a top portion, or first end 210A of the Bottle 210 storing the cosmetic product. When the pump is activated (e.g., by depressing an actuating element on top portion of the pump), a vacuum effect is created which draws the cosmetic product up through an opening in the top portion 210A of the Bottle 210 for dispensing through an outlet 205A in the Pump 205. The top portion 210A of Bottle 210 may include various features which allow it to be affixed with the Pump 205. In some embodiments, these features are designed to allow the Pump 205 to be removed by an end user, allowing the Bottle 210 to be refilled with additional cosmetic product. For example, a screw-type mechanism may be used, with the top portion 210A including threads on its exterior portion designed to be received by threads on the interior of the Pump 205.

Continuing with reference to FIG. 3, the blending end of the Combination Dispenser and Applicator includes a Blending Sponge 225 affixed to a lower portion, or second end 215B of the Bottle Collar 215 by Sponge Collar 220. The Bottle Collar 215 may be affixed to a bottom portion 210B of the Bottle 210 using similar features as those discussed above with reference to the affixing of the top portion 210A with the Pump 205. Alternatively, different affixing features may be used for each respective portion 210A, 210B. For example, the top portion 210A may include a screw-type feature to allow for removal by the user, while the bottom portion 210B may be affixed to the Bottle Collar 215 by glue to discourage removal.

In some embodiments, the Blending Sponge 225 may be removed by the user (e.g., via a twisting and/or pulling motion). Thus, the Blending Sponge 225 may be replaced if it becomes worn or the user desires a different type of blending sponge. The Blending Sponge 225 may be covered by Sponge Cap 230 when the Combination Dispenser and Applicator is not in use. The Sponge Cap 230 is removably affixed by joining it with an upper portion 215A of the Bottle Collar 215. The exterior dimensions of the Sponge Cap 230 are roughly approximate to that of the Pump 205, while the interior of the Sponge Cap 230 includes a hollow region sized to receive the Blending Sponge 225.

The size of the bottle may vary according to the overall size of the Combination Dispenser and Applicator. For example, in one embodiment, the Bottle 210 is a 0.5 ounce bottle with dimensions on either end selected to allow for connection to the Pump 205 and a Bottle Collar 215, respectively, to the Bottle 210. However, in other embodiments, longer bottles or different shape bottles may be used (e.g., cubical).

Figure 4:
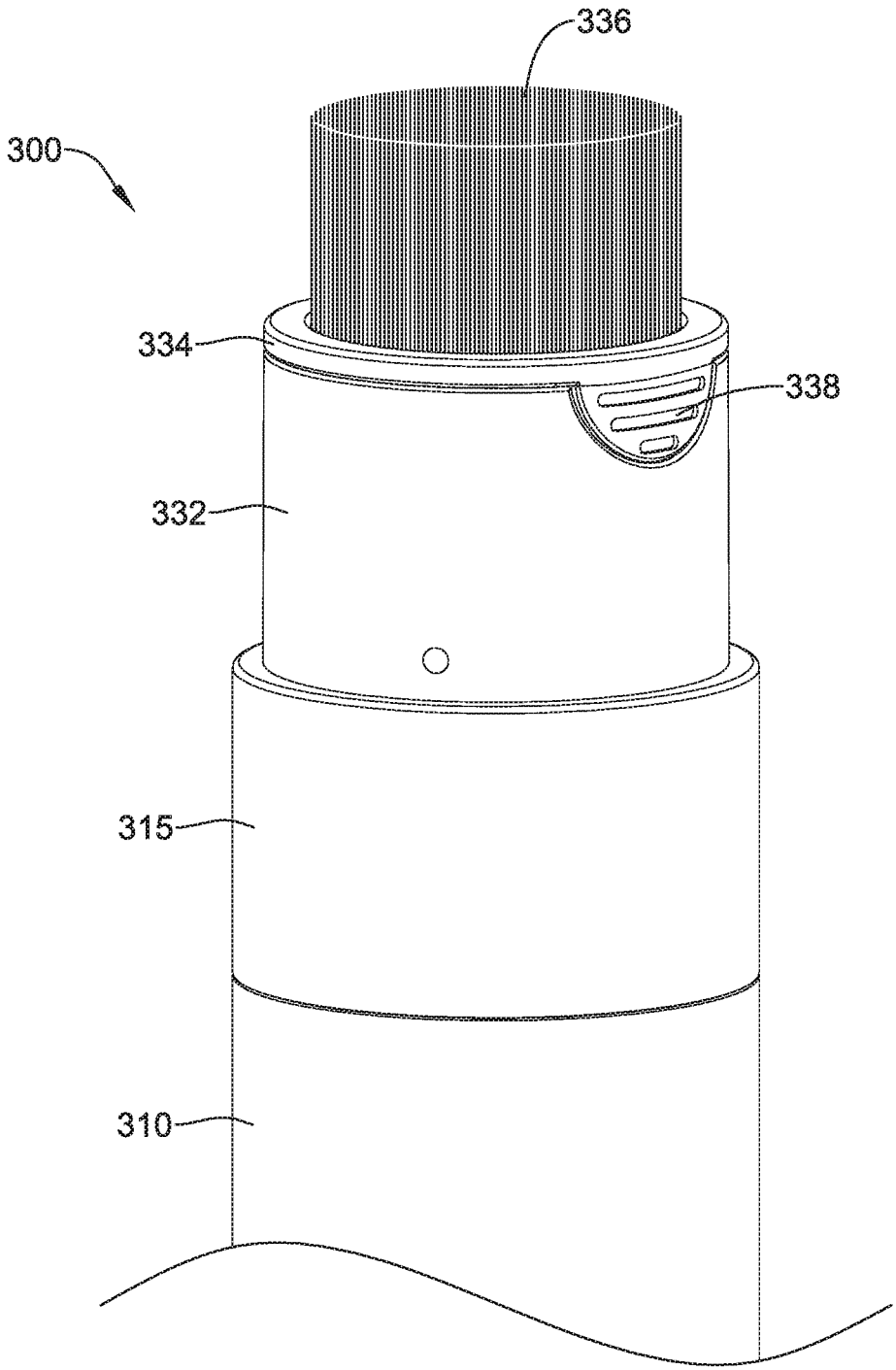
FIG. 4 provides a side view of an example Combination Dispenser and Applicator in an open configuration.

FIG. 4 provides an a side view of an example Combination Dispenser and Applicator 300 that may be similar in form and function other Combination Dispenser and Applicators disclosed herein. The Combination Dispenser and Applicator 300 may include a bottle 310. Bottle 310 may resemble the bottle 210 shown in FIG. 3 and may be connected to a pump (not shown; may be similar to pump 205 as shown in FIG. 3). A bottle collar 315 may be coupled to the bottle 310. A brush holder 332 may be coupled to the bottle collar 315. The brush holder 332 may include a brush 336. The brush 336 may be made of a material suitable for controlled application and blending of a cosmetic product material (e.g., a cosmetic product material that may be dispensed from the bottle 310 via a pump).

Figure 5:
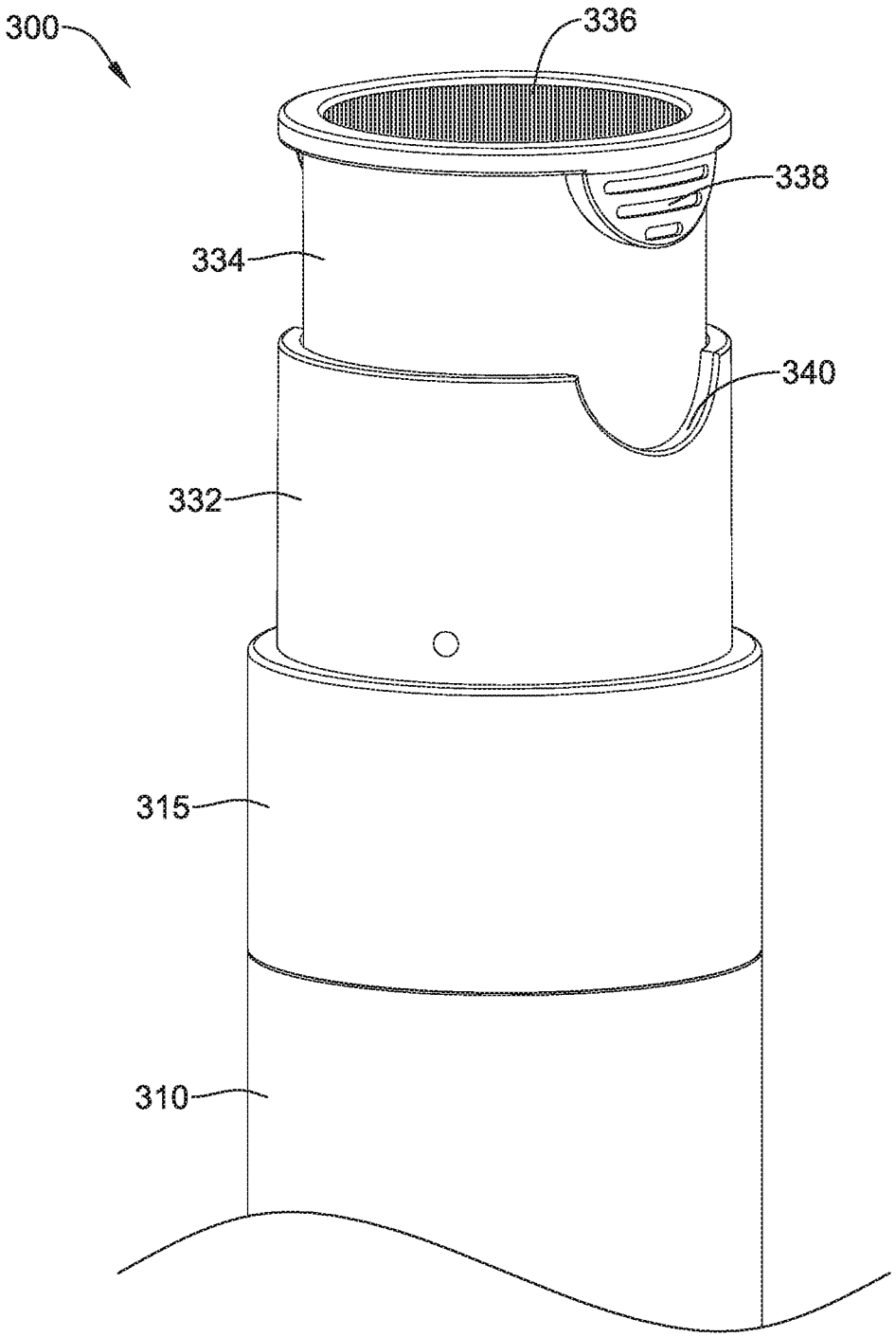
FIG. 5 provides a side view of an example Combination Dispenser and Applicator in a closed configuration.

The Combination Dispenser and Applicator 300 may include a sleeve 334 that is designed to move relative to the brush holder 332. For example, the sleeve 334 may slide along the brush holder 332 to either cover the brush 336 (e.g., as shown in FIG.5) or expose the brush 336 (e.g., as shown in FIG.4). In other words, the sleeve 334 is designed to shiftbetween a first position where the brush 336 is covered and a second position where the brush 336 is exposed. In at least some instances, the sleeve 334 may include one or more tabs or projections 338 that are designed to seat within one or more grooves 340 formed along the brush holder 332.

Figure 6:
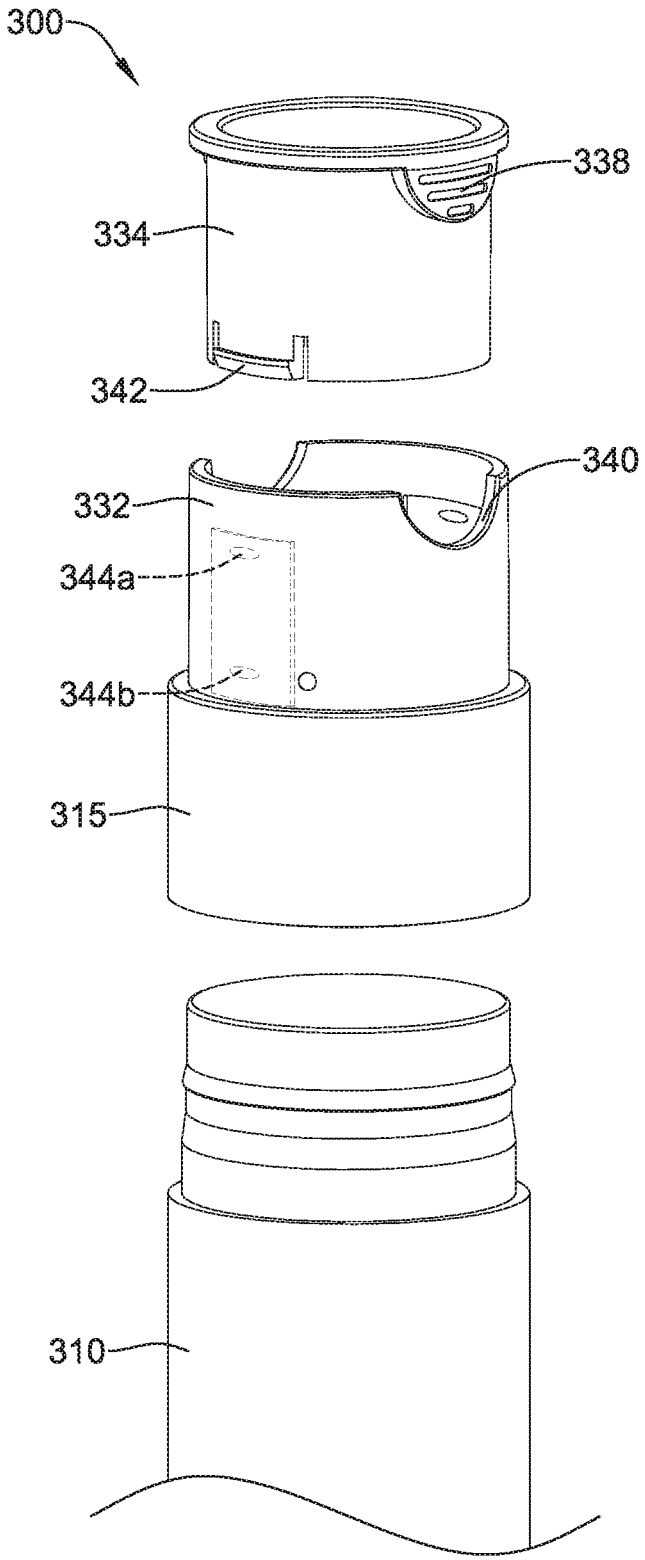
FIG. 6 provides an exploded view of an example Combination Dispenser and Applicator.

FIG. 6 provides an exploded view of the Combination Dispenser and Applicator 300. Here it can be seen that the sleeve 334 may include a flange 342 that projects from an outer surface of the sleeve 334. The flange 342 is designed to slide along the interior of the brush holder 332. In some instances, the brush holder 332 may include one or more bumps or projections 344*a*/344*b*. The bumps 344*a*/344*b* may be utilized to help hold or otherwise secure the sleeve 334 in either the covered or exposed configuration. For example, flange 342 may slide along the brush holder 332 and then "snap" into engagement with bump 344*a* in order to hold the sleeve 334 in the covered configuration. Similarly, flange 342 may slide along the brush holder 332 and then snap into engagement with bump 344*b* in order to hold the sleeve 334 in the exposed configuration. In some instances, additional flanges and/or bumps may be utilized.

Various decorative finishes may be applied on the Combination Dispenser and Applicator. For example, in some embodiments, a high gloss finish is placed on the exterior surface of the various components of the Combination Dispenser and Applicator. In other embodiments, other types of finishes (e.g., a matte finish) may be used.

The systems illustrated in the figures are not exclusive. Other systems may be derived in accordance with the principles of the disclosure to accomplish the same objectives. Although this disclosure has been described with reference to particular embodiments, it is to be understood that the embodiments and variations shown and described herein are for illustration purposes only. Modifications to the current design may be implemented by those skilled in the art, without departing from the scope of the disclosure. No claim element herein is to be construed under the provisions of 35 U.S.C. 112, sixth paragraph, unless the element is expressly recited using the phrase "means for."

The invention claimed:

1. A device for dispensing and applying a cosmetic product, the device comprising:

a bottle configured to hold a volume of cosmetic product, the bottle comprising a closed end and an open end;

a cosmetic dispensing member coupled to the open end of the bottle and comprising:

an outlet;

an actuating element configured to be actuated to enable delivery of a portion of the volume of cosmetic product through the outlet;

a brush having a first end coupled to the closed end of the bottle by one or more collar members and a brush holder; and a sleeve slidably disposed within a lumen of the brush holder, the sleeve slidable along the brush from the first end of the brush toward a second, free end of the brush;

wherein the outlet is accessible exterior to the cosmetic dispensing member when in an assembled configuration.

2. The device of claim 1, wherein the cosmetic dispensing member is an airless pump.

3. The device of claim 1, wherein the brush is coupled to the brush holder.

4. The device of claim 1, wherein the sleeve is designed to shift between a first position where the sleeve covers the brush and a second position where the brush is exposed.

5. The device of claim 1, wherein the sleeve includes a flange that is designed to engage a bump formed along the brush holder.

6. A combination dispenser and applicator, comprising:

a bottle designed to hold a cosmetic product, the bottle comprising a first end and second end;

a cosmetic dispensing member coupled to the first end of the bottle, the cosmetic dispensing member comprising an outlet and an actuating element configured to be actuated for delivery of a portion of the cosmetic product through the outlet;

a brush having a plurality of bristles each having a length extending between a first end coupled to a brush holder at the second end of the bottle and a second, unattached end; and a sleeve slidably coupled within a lumen of the brush holder, the sleeve slidable along the length of the brush bristles;

wherein the outlet is accessible exterior to the cosmetic dispensing member when in an assembled configuration.

7. The combination dispenser and applicator of claim 6, wherein the cosmetic dispensing member is an airless pump.

8. The combination dispenser and applicator of claim 6, wherein the sleeve is designed to shift between a first position where the sleeve covers the brush and a second position where the brush is exposed.

9. The combination dispenser and applicator of claim 6, wherein the sleeve includes a flange that is designed to engage a bump formed along the brush holder.

10. A combination dispenser and applicator, comprising:

a bottle designed to hold a cosmetic product, the bottle comprising a first end and second end;

a cosmetic dispensing member coupled to the first end of the bottle, the cosmetic dispensing member comprising an outlet and an actuating element configured to be actuated for delivery of a portion of the cosmetic product through the outlet;

a collar coupled to the second end of the bottle;

a brush holder coupled to the collar;

a brush including a plurality of bristles each having a length from a first end coupled to the collar to a second, unattached end; and a sleeve slidably disposed within a lumen of the brush holder, the sleeve slidable along the brush back and forth along the length of the bristles, the sleeve configured to move between a first position where the sleeve covers the brush and a second position within the brush holder where the brush is exposed;

wherein the outlet is accessible exterior to the cosmetic dispensing member when in an assembled configuration.

* * * * *